US005848439A

United States Patent [19]

Huseth et al.

[11] Patent Number: 5,848,439

[45] Date of Patent: Dec. 15, 1998

[54] NURSING CAPE WITH DEFORMABLE NECK OPENING

[76] Inventors: Cheryl M. Huseth, P.O. Box 351; Kathleen S. Johnson, P.O. Box 246, both of Wright, Wyo. 82732

[21] Appl. No.: 927,044

[22] Filed: Sep. 10, 1997

[51] Int. Cl.[6] ..... A41B 1/14; A41B 1/16; A41B 3/06; A41D 1/22

[52] U.S. Cl. ..... 2/104; 2/88; 2/48; 2/141.2

[58] Field of Search ..... 2/46, 48, 49.1, 2/49.2, 49.3, 49.4, 49.5, 50, 51, 52, 105, 104, 106, 174, 912, 913, 914, 132, 134, 139, 141.2, 74, 88, 141.1, 133, 142, 135, 143, 136, 137, 138, 140

[56] References Cited

U.S. PATENT DOCUMENTS

| | | | |
|---|---|---|---|
| 440,027 | 11/1890 | Gibble | 2/132 |
| 443,023 | 12/1890 | Weir | 2/132 |
| 579,788 | 3/1897 | Brodeur | 2/132 |
| 783,867 | 2/1905 | Hyman | 2/132 |
| 1,519,593 | 12/1924 | Schmidt | 2/132 |
| 1,565,207 | 12/1925 | Saul | 2/132 |
| 1,645,946 | 10/1927 | Cunrea | 2/132 X |
| 4,004,294 | 1/1977 | Pinch | 2/104 |
| 4,995,116 | 2/1991 | Beauchamp et al. . | |
| 5,034,999 | 7/1991 | Lubbers . | |
| 5,544,364 | 8/1996 | Weber . | |

*Primary Examiner*—Jeanette Chapman
*Attorney, Agent, or Firm*—Richard C. Litman

[57] ABSTRACT

A nursing cape which covers the infant and the torso of the mother to provide privacy. Viewing ports made of netting are provided to allow eye contact between mother and infant, while also providing ventilation. The viewing ports include covering flaps for additional privacy. A flexible, conventional head band becomes a neck-band by being is sewn into the collar of the cape, and grasps the mother's neck to hold the cape in place. The neck-band allows the cape to be put on using only one hand, thereby allowing the mother to hold the infant in her other arm. A split front panel is provided in the front of the cape forming two flaps. These flaps naturally overlap one another, to conceal both the infant and the torso of the wearer.

13 Claims, 2 Drawing Sheets

NURSING CAPE WITH DEFORMABLE NECK OPENING

BACKGROUND OF THE INVENTION

1. Field of the Invention

The present invention relates to a privacy cape for a nursing mother and, more specifically, a nursing cape adapted to cover a mother's upper torso and drape over an infant while breast feeding.

2. Description of the Related Art

Several types of clothing designed specifically for breast feeding have been previously envisioned. The prior art devices, however, tend to be difficult to take on and off, do not provide a high level of privacy while still allowing air flow to the infant, and/or do not allow eye contact between the mother and infant. U.S. Pat. No. 4,995,116 issued on Feb. 26, 1991 to Beauchamp et al. discloses an arms free privacy cape for breast feeding infants. While the cape allows eye contact between mother and child, it is difficult to don in that it requires the use of two hands to drape about the upper torso. U.S. Pat. No. 5,034,999 issued on Jul. 30, 1991 to Lubbers discloses a nursing bib having two frontal windows for viewing an infant while being breast fed. The bib is very difficult to put on, as the neck band is fastened in the rear. U.S. Pat. No. 5,544,364 issued on Aug. 13, 1996 to Weber discloses a nursing apron having a large neck band and a ventilated viewing portion attached to the neck band. As with the Lubbers bib, the Weber apron includes a neck band that is fastened in the rear, making it difficult to put on.

None of the above inventions and patents, taken either singularly or in combination, is seen to describe the instant invention as claimed. Thus a nursing cape solving the aforementioned problems is desired.

SUMMARY OF THE INVENTION

The present invention is directed to a nursing cape for use by a mother while breast feeding an infant. The cape covers the infant and the torso of the mother to provide privacy in public areas. Viewing ports made of netting are provided to allow eye contact between mother and infant, while also providing ventilation. The viewing ports include flaps that cover the viewing ports for additional privacy. The flaps have fasteners to hold them in the closed position.

One of the main advantages of the present nursing cape over previous designs is the use of a flexible, plastic (or metallic) neck-band sewn into the collar of the cape. The flexible neck-band is stretched to fit about the nape and sides of the neck of the mother, and the band snaps back to its original shape to grasp the mother's neck, thereby holding the cape in place. By this method, the cape can be put on using only one hand, thereby allowing the mother to hold the infant in her other arm.

The drape portion of the cape has a split front panel with a left closure flap and a right closure flap. When the neck-band is slipped about the neck of a wearer, these flaps naturally overlap one another, to conceal the infant and the torso of the wearer. For more security, however, three optional fasteners may be included to hold the closure flaps in the overlapping position.

Accordingly, it is a principal object of the invention to provide a nursing cape that may be taken on and off using only one hand.

It is another object of the invention to provide privacy to a mother while breast feeding an infant.

It is a further object of the invention to maintain eye contact between a mother and infant, while covering the infant and the torso of the mother during breast feeding.

It is an object of the invention to provide improved elements and arrangements thereof in a nursing cape for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
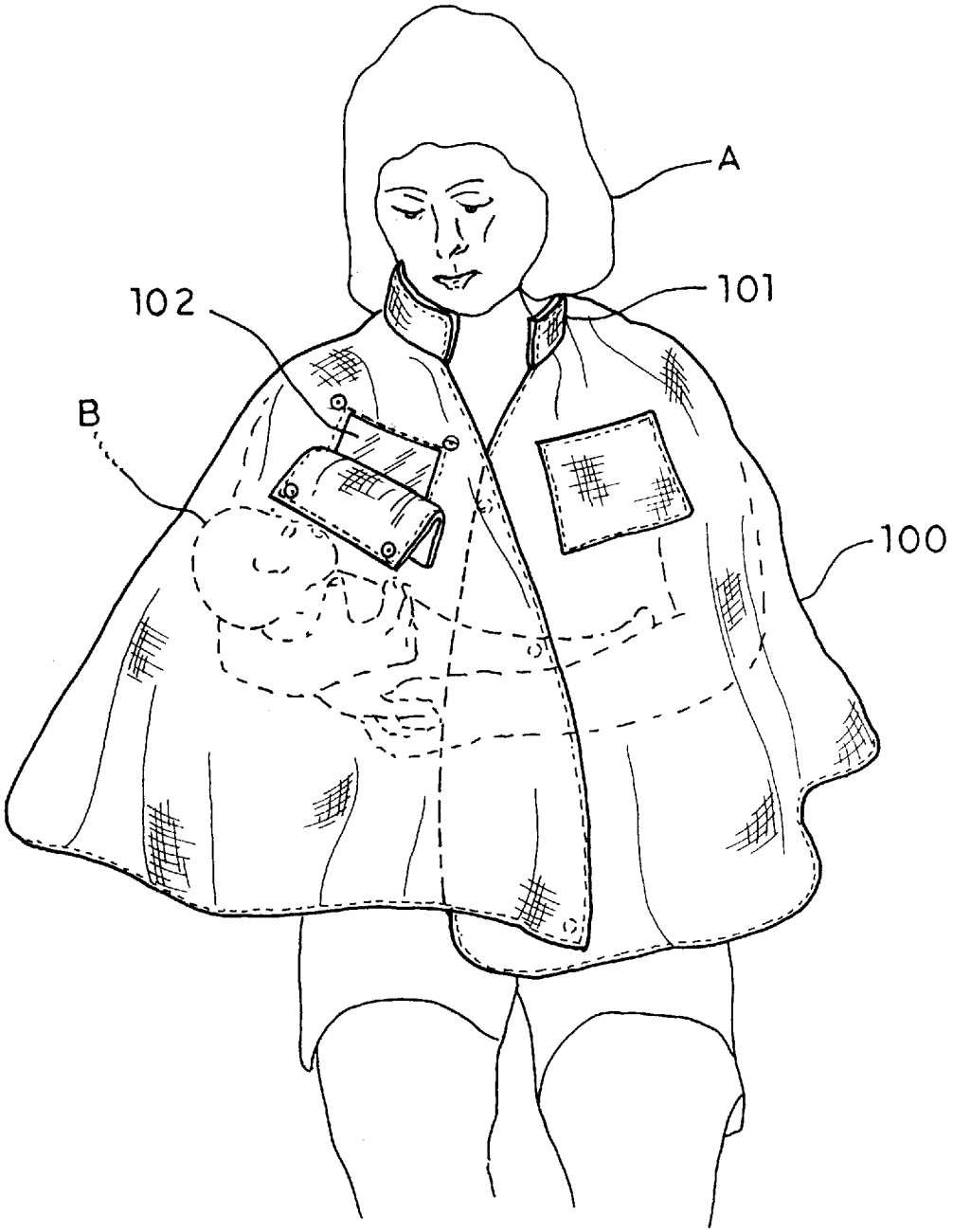
FIG. 1 is an environmental view of a mother breast feeding an infant using a first embodiment of the nursing cape according to the present invention.

The present invention is directed to a nursing cape, one embodiment of which is shown in FIG. 1. A mother A is shown breast feeding an infant B while wearing the nursing cape 100. In this way, the mother and infant are afforded privacy, while viewing port 102 allows mother and infant to maintain eye contact.

An important advantage of the present nursing cape over previous designs is in the collar 101 of the cape 100. Within the collar 101 a flexible, plastic (or metallic) neck-band (similar in construction to headbands used to hold hair) is sewn into place. The flexible neck-band has a great degree of elastic memory that biases the neck-band (and the collar) toward its static, small diameter shape after the neck-band is stretched to fit about the neck of a wearer. This design allows the cape to be put on using only one hand, thereby not disturbing the infant while breast feeding. A mother holding a baby in one arm, can simply grasp the collar, place the nursing cape collar about her neck, and pull the cape over her torso while the neck-band "snaps" into place about her neck. This embodiment of the nursing cape, as shown in FIG. 1, has a "stand-up" style collar 101.

Figure 2:
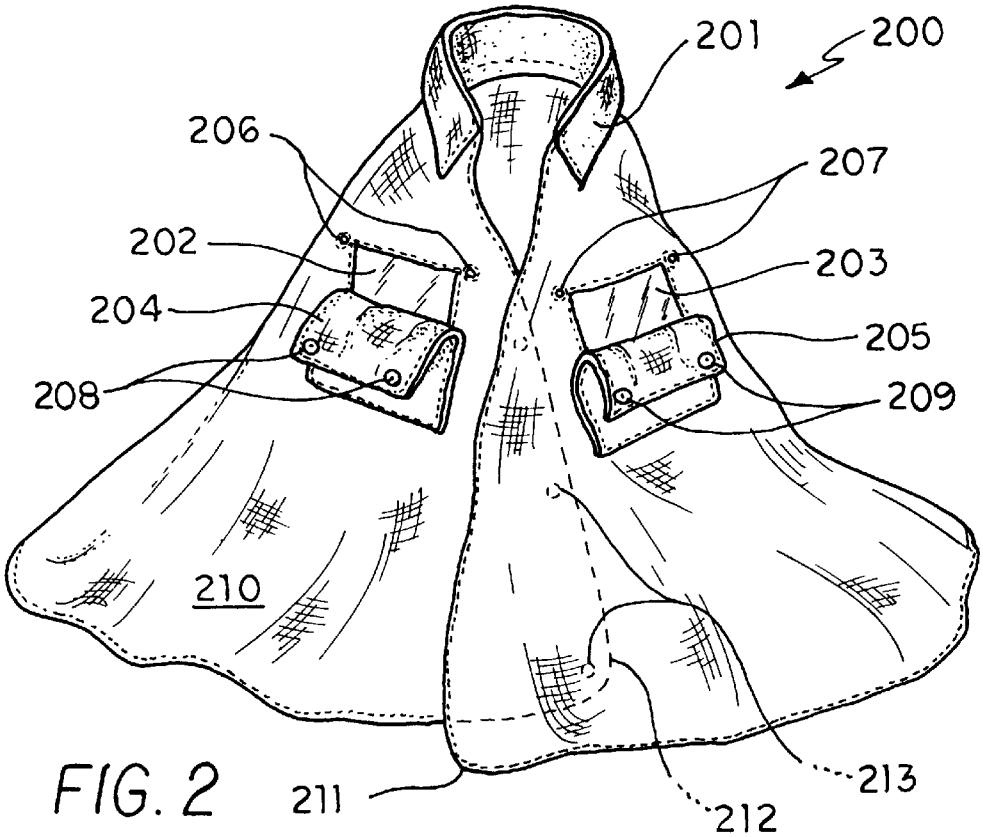
FIG. 2 is a front view of a second embodiment of the nursing cape according to the present invention with the viewing ports open.
Figure 3:
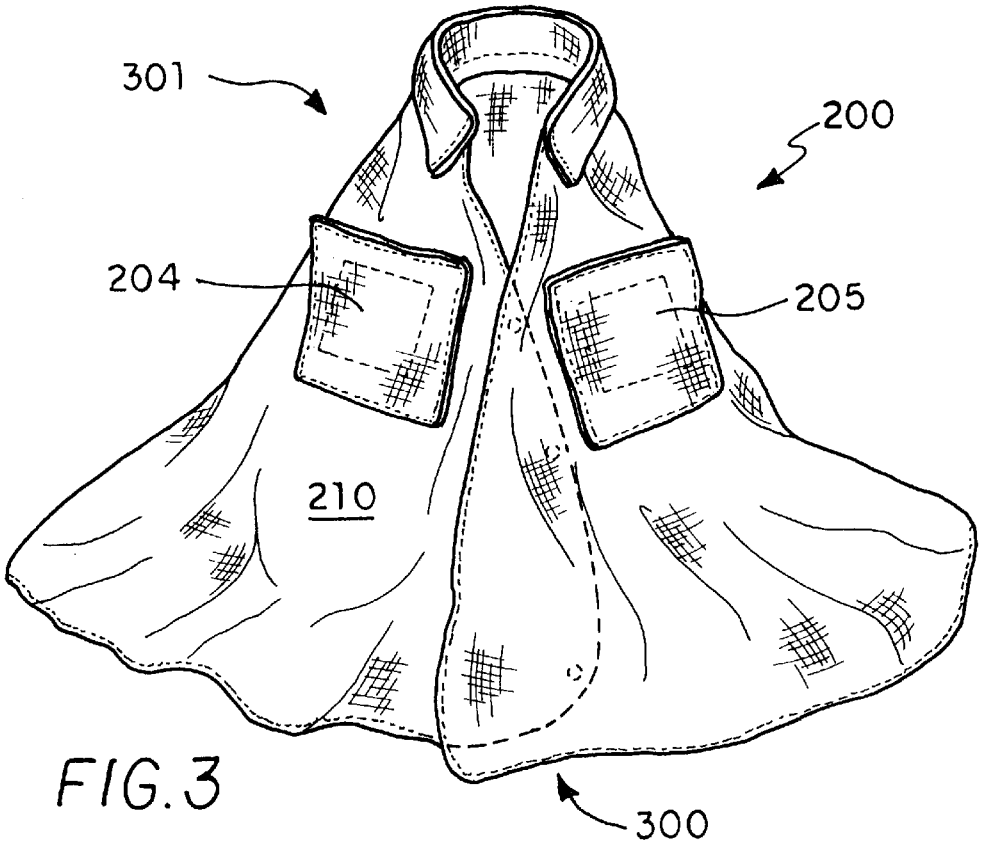
FIG. 3 is a front view of the second embodiment of the nursing cape of FIG. 2, with the viewing ports closed.

The details of both embodiments of the nursing cape are described with reference to FIGS. 2 and 3, which show the second embodiment of the nursing cape 200. Nursing cape 200 differs from the first embodiment in that a "polo" style collar 201 is used as opposed to the stand-up collar 101. Collar 201 also includes a neck-band sewn therein, as described above with reference to the first embodiment. Other than the different collar styles, both embodiments are substantially identical.

To allow eye contact between mother and infant during breast feeding, a right viewing port 202, and a left viewing port 203 are installed in the front panel of the drape 210 portion of the nursing cape. These substantially rectangular ports are covered with a netting material to provide ventilation for the infant. A right flap 204 and a left flap 205 are provided to cover the left and right viewing ports, respectively, for additional privacy. Both of the flaps include fasteners (208 on the right and 209 on the left) that mate with fasteners (206 on the right and 207 on the left) on the drape of the cape. As shown in FIG. 3, when the fasteners are connected, the flaps cover the viewing ports. While the preferred fastener is hook and loop material (e.g., VELCRO™), buttons, snaps or other fasteners may be used. Hook and loop material is preferred because other fasteners require additional force to close, and this may disturb the infant.

The drape portion 210 has a split front panel 300 and a closed, unadorned rear panel 301. The cape is made of a lightweight fabric that is easy to clean. A lining is included to prevent the cape from being see-through. The lining also adds weight to the drape 210 so that it hangs over the mother's torso properly. The split front panel 300 includes a left closure flap 212 and a right closure flap 211. When the neck-band is slipped over the head of a wearer, these flaps naturally overlap one another, to conceal the infant and the torso of the wearer. For more security however, a number (preferably three) of fasteners 213 are provided. As with fasteners 206–209, the preferred fastener is hook and loop material.

The above described nursing cape allows a mother to breast feed her infant without changing her schedule to find a private location to do so. Additionally, as the cape does not require any special clothing, a mother can use the cape in conjunction with her existing wardrobe. This provides a cost savings to the mother. The term "public area" as used in this application refers to any location wherein the mother would not be comfortable with her breast exposed. These include but are not limited to: home; work; shopping; school events; airports; and restaurants.

It is to be understood that the present invention is not limited to the embodiments described above, but encompasses any and all embodiments within the scope of the following claims.

We claim:

1. A nursing cape comprising:

a drape portion having a split front panel and a closed rear at least one viewing port for allowing eye contact between a nursing mother wearing said cape and an infant breast feeding within said cape; and a collar having a resilient, open ended neck-band built therein;

said neck-band having a generally circular shape with a small diameter in a relaxed static state, said neck-band being capable of being deformed to a larger diameter generally circular shape; whereby said neck-band is deformed to a larger diameter to allow said cape to be donned by pulling the collar about the nape and sides of the neck of the nursing mother and is released to return to the relaxed static state, said neck-band thereby grasping the neck of the nursing mother and supporting said drape portion.

2. The nursing cape as defined in claim 1, further comprising at least one flap for covering said at least one viewing port.

3. The nursing cape as defined in claim 2, wherein said at least one flap includes fastener means for holding said at least one flap in a closed position, thus to cover said at least one viewing port.

4. The nursing cape as defined in claim 3, wherein said fastener means is a hook and loop fastener.

5. The nursing cape as defined in claim 4, wherein:

said at least one viewing port comprises a first and second viewing port;

said at least one flap comprises a first and second flap;

said first viewing port is dimensioned and configured to allow eye contact when the infant is feeding on one breast of the mother; and said second viewing port allows said eye contact when the infant is feeding on the other breast of the mother.

6. The nursing cape as defined in claim 1, wherein said collar is a polo collar.

7. The nursing cape as defined in claim 1, wherein said collar is a stand-up collar.

8. The nursing cape as defined in claim 1, wherein said split front panels includes a first and second closure flap, said flaps adapted to overlap one another to conceal the infant and the torso of the mother.

9. The nursing cape as defined in claim 8, wherein:

said first closure flap includes first fastening means;

said second closure flap includes second fastening means; and said first fastening means mate with said second fastening means to maintain said closure flaps in an overlap position.

10. The nursing cape as defined in claim 9 wherein said first fastening means and said second fastening means are hook and loop fasteners.

11. A nursing cape comprising:

a drape portion having a split front panel and a closed rear panel;

first and second viewing ports, said first viewing port allowing eye contact between a mother wearing said cape and an infant breast feeding on one breast of the mother, and said second viewing port allows eye contact when the infant is feeding on the other breast of the mother;

a first flap for covering said first viewing port;

a second flap for covering said second viewing port;

a first hook and loop fastener means for holding said first flap in a closed position wherein said first viewing port is covered;

a second hook and loop fastener means for holding said second flap in a closed position wherein said second viewing port is covered;

said split front panel including a first closure flap and a second closure flap, said first and second closure flaps adapted to overlap one another to conceal the second person and the torso of the first person;

said first closure flap includes a first closure hook and loop fastener;

said second closure flap includes a second closure hook and loop fastener;

said first closure hook and loop fastener mates with said second closure hook and loop fastener to maintain said closure flaps in an overlap position; and a collar having a resilient, open end neck-band built therein, said neck-band having a generally circular shape with a small diameter in a relaxed static state, said neck-band capable of being deformed to a larger diameter, generally circular shape; whereby said neck-band is deformed to a larger diameter to allow said cape to be donned by pulling the collar about the nape and sides of the neck of the mother and is released to return to the relaxed static state, said neck-band thereby grasping the neck of the mother and supporting said drape portion.

12. The nursing cape as defined in claim 11, wherein said collar is a polo collar.

13. The nursing cape as defined in claim 11, wherein said collar is a stand-up collar.

* * * * *